US009777944B2

(12) United States Patent
Mehta et al.

(10) Patent No.: US 9,777,944 B2
(45) Date of Patent: Oct. 3, 2017

(54) SOUND ENCLOSURE FOR A COMPRESSOR

(71) Applicant: TRANE INTERNATIONAL INC., Piscataway, NJ (US)

(72) Inventors: Pavak Anilbhai Mehta, LaCrescent, MN (US); John Scott Hausmann, LaCrosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 14/422,138

(22) PCT Filed: Aug. 19, 2013

(86) PCT No.: PCT/US2013/055601

§ 371 (c)(1),
(2) Date: Feb. 17, 2015

(87) PCT Pub. No.: WO2014/028938

PCT Pub. Date: Feb. 20, 2014

(65) Prior Publication Data

US 2015/0219360 A1 Aug. 6, 2015

Related U.S. Application Data

(60) Provisional application No. 61/684,293, filed on Aug. 17, 2012.

(51) Int. Cl.
*F24F 13/24* (2006.01)
*F04D 29/40* (2006.01)
(Continued)

(52) U.S. Cl.
CPC ..... *F24F 13/24* (2013.01); *F04C 29/06* (2013.01); *F04D 29/40* (2013.01); *F04D 29/664* (2013.01); *F24F 2013/242* (2013.01)

(58) Field of Classification Search
CPC ..... F04C 29/06; F04D 29/40; F04D 29/664; F24F 13/24; F24F 2013/242; F24F 1/12; F25B 2500/12; F25B 2500/13
(Continued)

(56) References Cited

U.S. PATENT DOCUMENTS 4,508,486 A * 4/1985 Tinker ..... F04D 29/664 415/119
5,272,285 A * 12/1993 Miller ..... F04B 39/0033 181/202
(Continued)

FOREIGN PATENT DOCUMENTS

JP 55-45084 3/1980
JP 55-045084 U * 3/1980
(Continued)

OTHER PUBLICATIONS

International Search Report and Written Opinion for International Application No. PCT/US2013/055601, dated Dec. 17, 2013, 11 pgs.
(Continued)

*Primary Examiner* — Devon Kramer
*Assistant Examiner* — Connor Tremarche
(74) *Attorney, Agent, or Firm* — Hamre, Schumann, Mueller & Larson, P.C.

(57) ABSTRACT

A sound enclosure of a compressor to attenuate an operational sound level of the compressor is disclosed. The sound enclosure may be configured to generally enclose the compressor and attenuate radiantly emitted sound by the compressor. The sound enclosure may be configured to include a plurality of assembly sections, particularly two side sections and one bottom section, where the two side sections can be joined together like two halves of a clam shell and joined to the bottom section to facilitate easy assembly. The sound enclosure may form openings at longitudinal ends of
(Continued)

the sound enclosure to accommodate refrigerant lines. The assembly sections of the sound enclosure may include one or more openings to accommodate a junction box, wire bundles, oil lines, mounting mechanisms, etc.

18 Claims, 11 Drawing Sheets

(51) Int. Cl.
*F04D 29/66* (2006.01)
*F04C 29/06* (2006.01)

(58) Field of Classification Search
USPC ..... 417/312
See application file for complete search history.

(56) References Cited

U.S. PATENT DOCUMENTS 5,274,200 A 12/1993 Das et al.
5,588,810 A * 12/1996 DiFlora ..... F04B 39/0033 181/202
5,694,926 A * 12/1997 DeVries et al. ..... 128/205.24
5,804,775 A 9/1998 Pinnington
5,997,258 A 12/1999 Sawyer et al.
6,062,033 A 5/2000 Choi
6,116,374 A 9/2000 Westerbeke, Jr.
6,145,616 A 11/2000 Ewanek
7,278,834 B2 * 10/2007 Herrick ..... F04B 39/0044 248/638
7,318,608 B2 * 1/2008 Swartz ..... B60P 7/08 280/789
7,357,219 B2 4/2008 Mafi et al.
7,526,903 B2 5/2009 Kandasamy
7,845,463 B2 12/2010 Yabe et al.
8,061,475 B2 11/2011 Mori et al.
2005/0167189 A1 8/2005 Aisenbrey
2005/0274569 A1 * 12/2005 Seel ..... F01C 21/10 181/202
2006/0144637 A1 7/2006 Swartz et al.
2006/0283657 A1 12/2006 Dubensky et al.
2007/0169504 A1 7/2007 Vinocur
2008/0099274 A1 5/2008 Seel
2008/0099275 A1 5/2008 Seel
2009/0065299 A1 3/2009 Vito et al.
2010/0070085 A1 * 3/2010 Harrod ..... F24F 11/0086 700/276
2010/0116583 A1 * 5/2010 Seedorf ..... F04B 53/002 181/205
2011/0017544 A1 * 1/2011 Bodwell ..... F04B 35/06 181/200
2011/0067949 A1 3/2011 Mori et al.
2012/0193505 A1 * 8/2012 Baron ..... F24F 1/40 248/636
2012/0251357 A1 * 10/2012 Yokoi ..... B60H 1/00514 417/410.1
2014/0050572 A1 * 2/2014 Mehta ..... F04D 29/40 415/182.1

FOREIGN PATENT DOCUMENTS

JP 2007-035043 2/1995
JP 2000-199482 7/2000
JP 2009-293905 12/2009

OTHER PUBLICATIONS

U.S. Non-final Office Action for U.S. Appl. No. 13/970,325, dated Oct. 7, 2015, 16 pgs.

* cited by examiner

SOUND ENCLOSURE FOR A COMPRESSOR

FIELD OF TECHNOLOGY

Embodiments disclosed herein relate generally to a heating, ventilation and air conditioning (HVAC) system. More specifically, embodiments disclosed herein relate generally to a sound enclosure for a compressor of a HVAC system to attenuate an operational sound level of the compressor.

BACKGROUND

When in operation, a compressor of a HVAC system can generate vibration and sound. For example, in a chiller system, the compressor is one of the main sources of operational sound. The operational sound of the compressor can migrate to other parts of the HVAC system through, for example, refrigerant lines. The operational sound of the compressor can also be emitted radiantly to the environment.

SUMMARY

A sound enclosure for a compressor of a HVAC system to attenuate an operational sound level of the compressor is disclosed herein. In some embodiments, the sound enclosure may include a first side section and a second side section, and a bottom section. In some embodiments, the sound enclosure is configured to extend in a longitudinal direction to enclose the compressor of the HVAC system and impede operational sound from the compressor, for example emitted radiantly by the compressor. In some embodiments, the sound enclosure may include one end opening in the longitudinal direction that is configured to allow refrigerant line access to the compressor.

In some embodiments, the sound enclosure is configured to have a three-piece construction: two side sections and one bottom section, or a two-piece construction: two side sections. In some embodiments, the pieces of the sound enclosure can be generally fastened together by, for example, screws, latches, quarter turn screws, etc.

In some embodiments, the sound enclosure is configured to have at least one opening to accommodate a junction box for the compressor of the HVAC system. In some embodiments, the first side section, the second side section and the bottom section have overlapped portions. In some embodiments, the first side section, the second side section and the bottom section are joined to each other at the overlapped portions. In some embodiments, the first side section, the second side section or the bottom section of the sound enclosure may include at least one opening to accommodate a wire and/or a refrigerant line that are configured to be connected to the compressor of the HVAC system. In some embodiments, the bottom section of the sound enclosure may include a plurality of apertures to accommodate a mounting mechanism for the compressor of the HVAC system.

A chiller system with a sound enclosure may include longitudinal end openings on the sound enclosure and the end openings are configured to accommodate refrigerant lines coupled to the compressor. In some embodiments, the compressor of the chiller system may be supported by a mounting mechanism through an aperture of a bottom section of the sound enclosure. In some embodiments, the mounting mechanism may be attached to a supporting beam of the chiller system directly. In some embodiments, the mounting mechanism supporting the compressor of the chiller system may be configured to impede sound transmission between the compressor and the supporting beam of the chiller system.

In some embodiments, the sound enclosure may include a side section that is configured to have an opening to accommodate a junction box, such as a heater box for the compressor. In some embodiments, the sound enclosure of the chiller system may be configured to impede operational sound, for example that may be radiantly emitted by the compressor. In some embodiments, the refrigerant lines of the compressor may be equipped with sound isolating devices that are configured to impede sound transmission between the compressor and the refrigerant lines.

In some embodiments, the sound enclosure may include a height that is larger than a width, which can be configured to accommodate a compressor with a height that is larger than a width, such as for example, a scroll compressor. In some embodiments, the sound enclosure can include two side sections and a bottom section. In some embodiments, openings that allow refrigerant line access to the compressor inside the sound enclosure may be positioned on the side sections of the sound enclosure. In some embodiments, the openings can open through a seam between the side sections.

Other features and aspects of the embodiments will become apparent by consideration of the following detailed description and accompanying drawings.

BRIEF DESCRIPTION OF THE DRAWINGS

FIG. 6A is a perspective view of the sound enclosure with end plugs detached. FIG. 6C illustrates that the sound enclosure can be closed by a trim strip.

FIG. 7A is an exploded view of the sound enclosure. FIG. 7B is another view of the sound enclosure with a compressor positioned inside the sound enclosure. A side section is removed for a clearer view. FIG. 7C illustrates the sound enclosure with refrigerant lines extending outwardly from the inside of the sound enclosure.

DETAILED DESCRIPTION

When in operation, a compressor of a HVAC system may generate sound. The sound of the compressor can migrate to other parts of the HVAC system through, for example, refrigerant lines, and can also be emitted radiantly to the environment.

In the following description of the illustrated embodiments, a sound enclosure of a compressor is disclosed. The sound enclosure may be configured to generally enclose the compressor and attenuate sound from the compressor, for example, sound that may be radiantly emitted by the compressor. The sound enclosure may be configured to include a plurality of assembly sections, particularly two side sections and one bottom section, where the two side sections can be joined together like two halves of a clam shell, and joined to the bottom section to facilitate easy assembly. In some embodiments, the side sections and the bottom section of the sound enclosure may form end openings at longitudinal ends of the sound enclosure to accommodate refrigerant lines. In some embodiments, the side sections may have openings along a height to accommodate, for example, refrigerant lines. The assembly sections of the sound enclosure may include one or more openings to accommodate a junction box, wire bundles, oil lines, mounting mechanisms, etc. The sound enclosure can be used to attenuate the operational sound level of a compressor of a HVAC system, such as a screw compressor. The sound enclosure can also be applied to other types of compressors, when it is desirable to attenuate the operational sound levels. In some embodiments, the sound enclosure may be configured to attenuate sound particularly from a range of about 250 Hz to about 2,000 Hz, which generally is the range of sound frequency for the operational sound of the compressor. In some embodiments, the sound enclosure may be configured to attenuate sound particularly from a range of about 250 Hz to about 10,000 Hz.

In some embodiments, the side sections and/or bottom section may extend in a longitudinal direction to accommodate a compressor that has a length that is larger than a height. In some embodiments, the side sections may extend in along a height of the sound enclosure to accommodate a compressor that has a height that is larger than a width.

References are made to the accompanying drawings that form a part hereof, and in which is shown by way of illustration of the embodiments may be practiced. It is to be understood that the terms used herein are for the purpose of describing the figures and embodiments and should not be regarded as limiting the scope of the present application.

Figure 1:
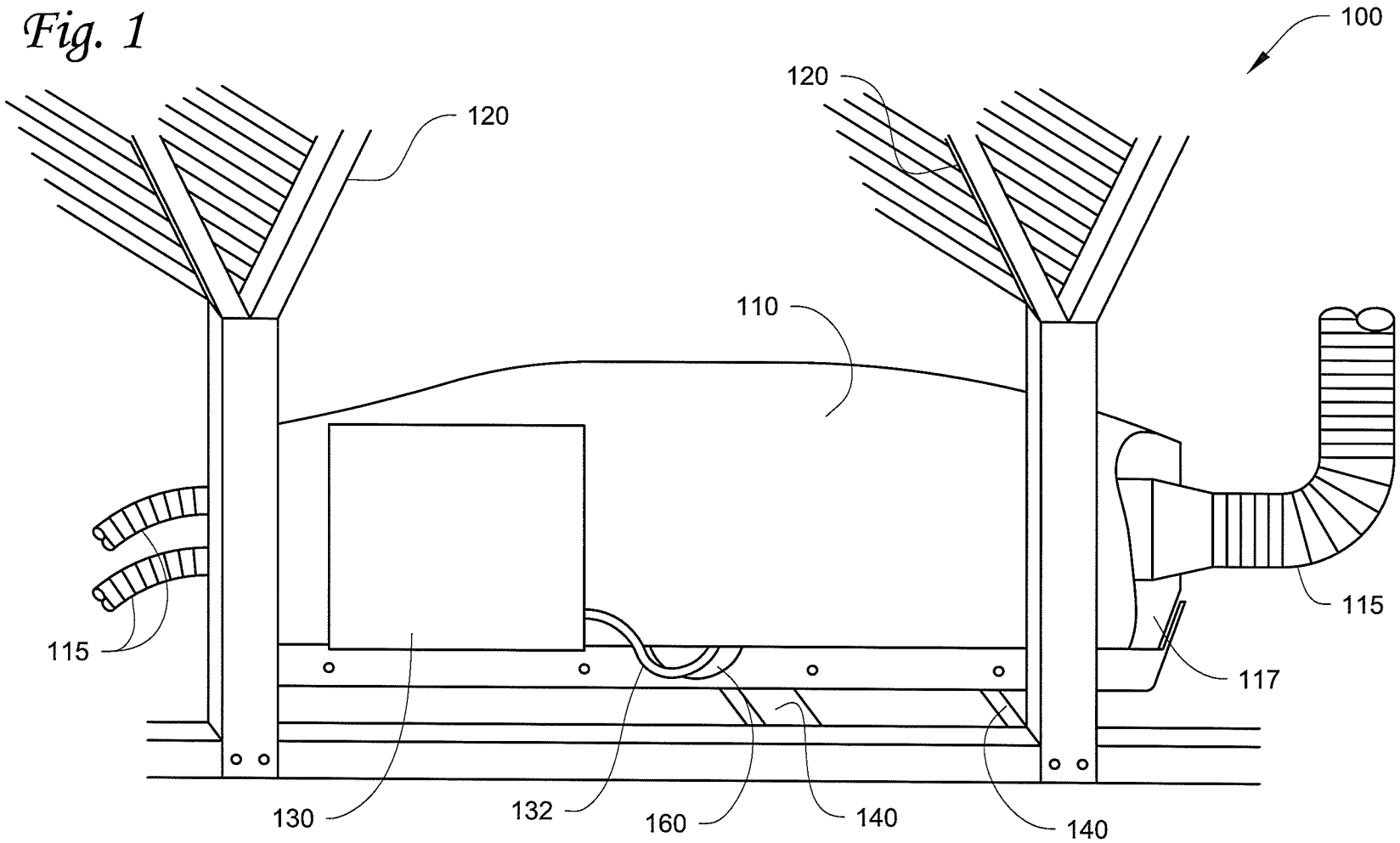
FIG. 1 illustrates a partial view of a HVAC system with a compressor enclosed by a sound enclosure.

FIG. 1 illustrates a chiller system 100 with a compressor that is enclosed in a sound enclosure 110. The sound enclosure 110 is generally located at a lower part of the chiller system 100. The compressor is connected to refrigerant lines 115 that extend out of the sound enclosure 110 through an opening(s) 117 of the sound enclosure 110. The chiller system 100 also includes condenser coils 120 that are generally positioned in an upper part of the chiller system. The sound enclosure 110 also accommodates a compressor junction box 130, such as a compressor heater box. The compressor junction box 130 is coupled to the compressor by wires 132 through an opening 160, for example, on a side of the enclosure 110. The sound enclosure 110 may be supported by supporting beams 140 that are positioned underneath the sound enclosure 110.

It is to be appreciated that the chiller system 100 as illustrated in FIG. 1 is exemplary. The chiller system may be configured differently. Generally, the sound enclosure is configured to accommodate a compressor of a chiller system and the sound enclosure may include an opening(s) to allow refrigerant lines to extend out of the sound enclosure. Further, the sound enclosure may also be configured to have openings and/or apertures to support a junction box, wire bundles, oil lines, mounting mechanisms, etc. The sound enclosure as described herein may be configured to be suitable for compressors of a HVAC system, such as a screw compressor.

Figure 2A:
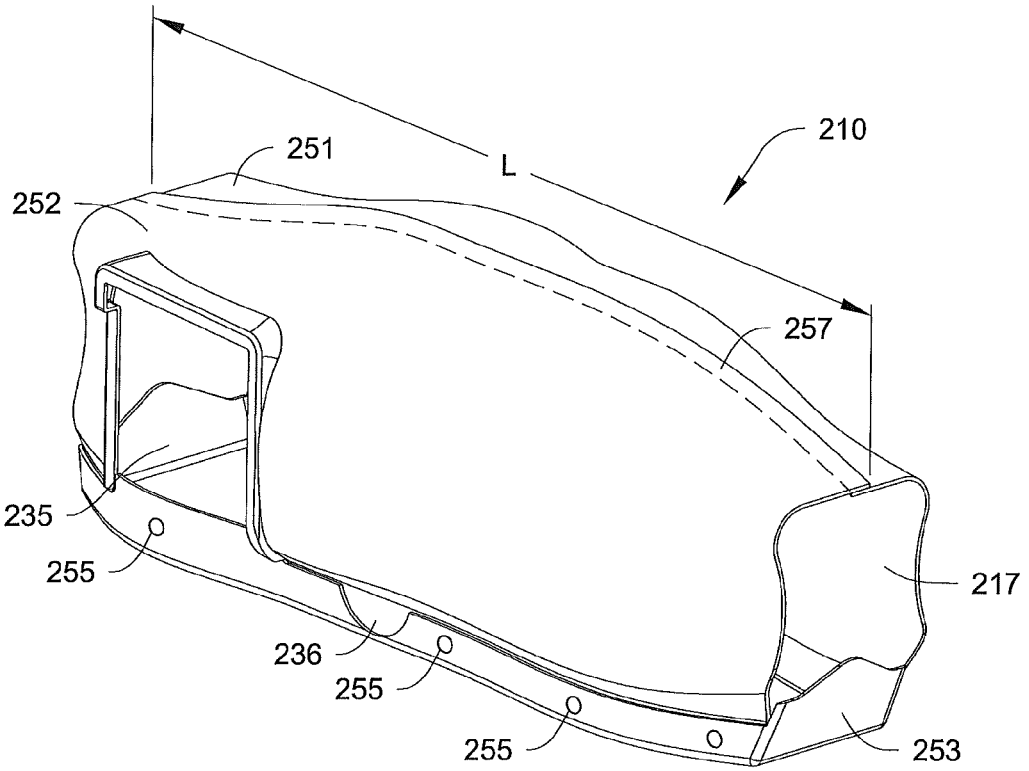
FIGS. 2A and 2B are elevated views of one embodiment of a sound enclosure.
Figure 2B:
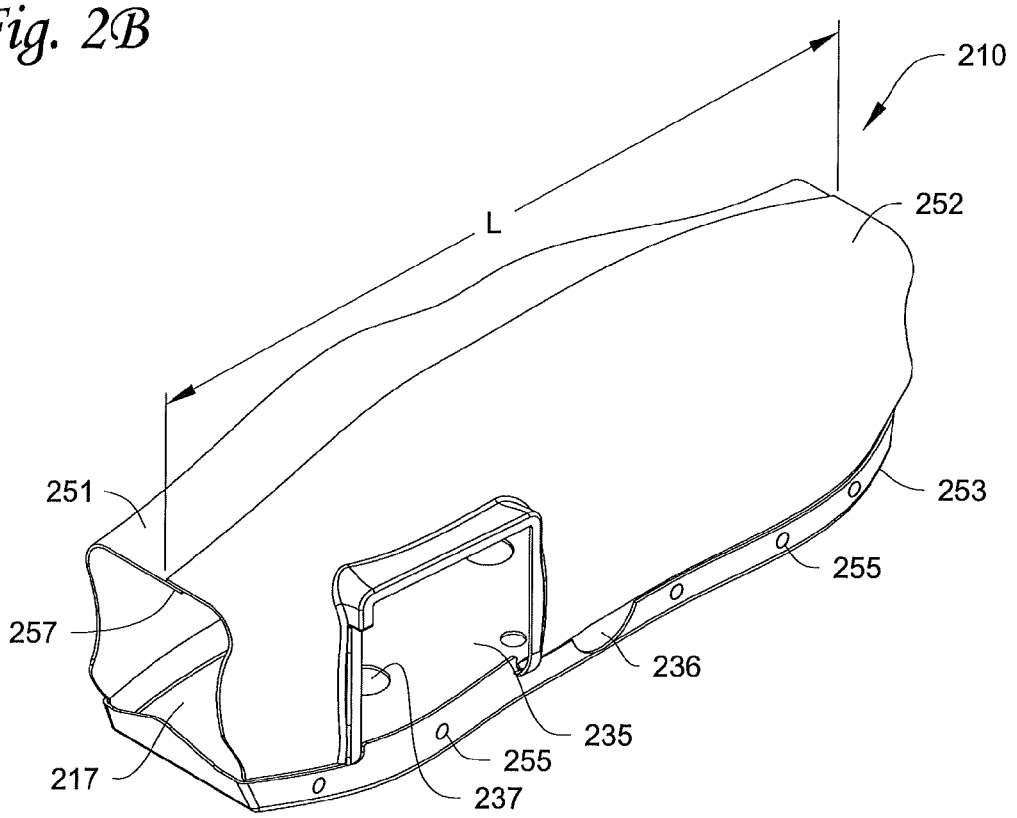

Referring to FIGS. 2A and 2B, elevated views of one embodiment of a sound enclosure 210 are illustrated. The sound enclosure 210 includes a plurality of assembly sections: side sections 251 and 252, and bottom section 253. In the illustrated embodiment, both of the side sections 251 and 252 are joined to the bottom sections 253 by, for example, a plurality of bolts 255. The side sections 251 and 252 have an overlapping section 257, in which the two side sections 251 and 252 can be joined together.

The side sections 251 and 252, and the bottom section 253 of the sound enclosure 210 form openings 217 on both ends of the sound enclosure 210 in a longitudinal direction of the sound enclosure 210 that is defined by a length L. In the illustrated embodiment of FIGS. 2A and 2B, the sound enclosure 210 can be suitable for a compressor with a length is larger than a height (e.g. the compressor 580 in FIG. 5). When the sound enclosure 210 is installed in a HVAC system to enclose a compressor of the HVAC system, the longitudinal direction of the sound enclosure 210 is about parallel to a refrigerant flow direction through the compressor.

The side section 252 may have an opening 235 that may be configured to accommodate a junction box and/or wire bundles (such as the junction box 130 in FIG. 1). The bottom section may also have an opening 236 that may be configured to accommodate a compressor wire bundles. The bottom section 253 has a plurality of apertures 237 that may be configured to accommodate mounting mechanisms for a compressor. (See FIG. 4 and the description below for one example of the mounting mechanism.) In general, the sound enclosure 210 may be configured to have openings and/or apertures to accommodate wires and/or lines connected to the compressor.

Figure 3A:
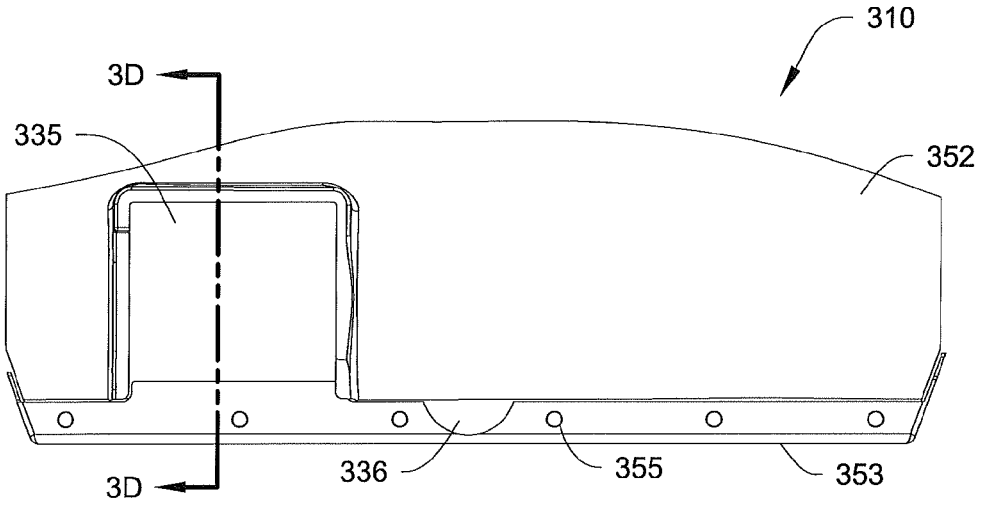
FIGS. 3A to 3D are different views of another embodiment of a sound enclosure.
Figure 3B:
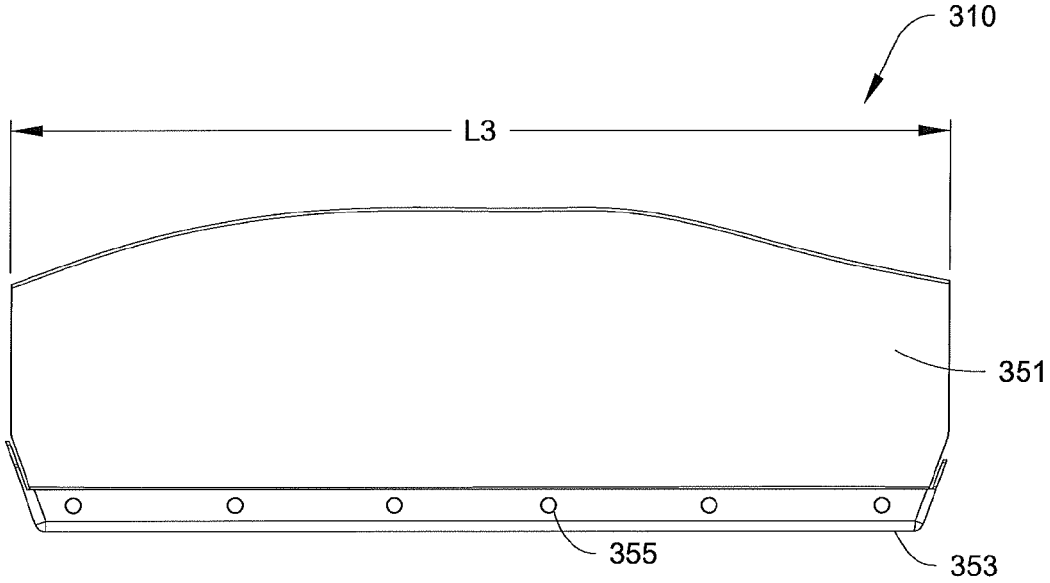

FIGS. 3A to 3D illustrate different views of a sound enclosure 310. FIGS. 3A and 3B are side views. The side views show that a side section 352 can be configured to have an opening 335. The opening 335 is configured to accommodate, for example, a junction box 130 as illustrated in FIG. 1. A bottom section 353 is configured to have an opening 336. Side sections 351 and 352 are configured to be joined to the bottom section 353 through, for example, bolts 355.

Figure 3C:
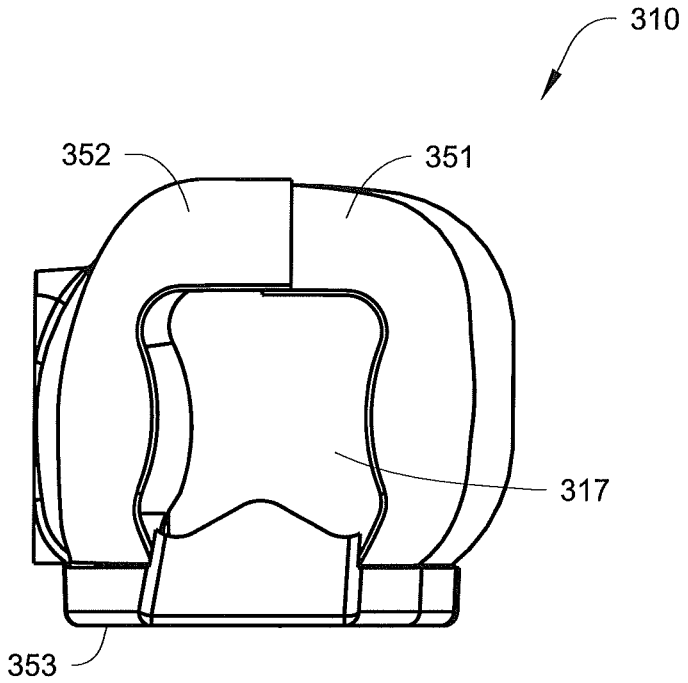

From the end view as illustrated in FIG. 3C, an opening 317 can be seen. The sound enclosure 310 can be configured to have two openings 317 located at both ends of a longitudinal direction of the sound enclosure 310 that is defined by a length L3 as shown in FIG. 3B.

Figure 3D:
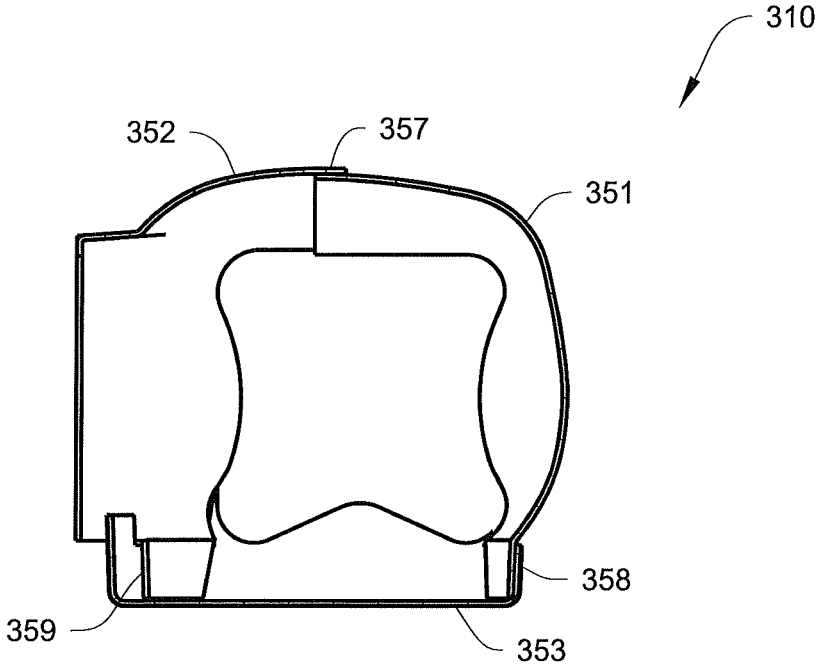

FIG. 3D illustrates a sectional view along line 3D-3D in FIG. 3A. The side sections 351 and 352 have an overlapped portion 357 and join together like two halves of a clam shell. The side section 351 and the bottom section 353 have an overlapped portion 358, and the side section 352 and the bottom section 353 have an overlapped portion 359.

As illustrated in FIGS. 3A, 3B (as well as FIG. 2B), the overlapping portion 357, 358 and/or 359 can extend the whole length L3 of the sound enclosure 310. The overlapped portions 357, 358 and 359 may help join the side sections 351 and 352, and the bottom section 353 together.

Different joining methods can be applied to the overlapped sections 357, 358 and 359 to facilitate joining the sections 351, 352 and 353 together. For example, the side sections 351, 352 and the bottom section 353 can be fastened together by, for example, screws, latches and quarter turn screws. It will be appreciated that the method of fastening and the type of fasteners are not limited, as other suitable fastener may be employed. The holding methods can be reversible so that the sound enclosure 310 can be dissembled if necessary.

It is to be appreciated that the side sections 352 and 353 can be one integrated piece, rather than two separate pieces. In addition, the side sections 351 and 352 may also be configured to have a curved profile from the side views (as illustrated in FIGS. 3A and 3B) and/or from the end views (as illustrated in FIGS. 3C and 3D). The profiles of the side sections 351 and 352 may help the sound closure 310 to stay close to other components of a HVAC system when installed.

Figure 4:
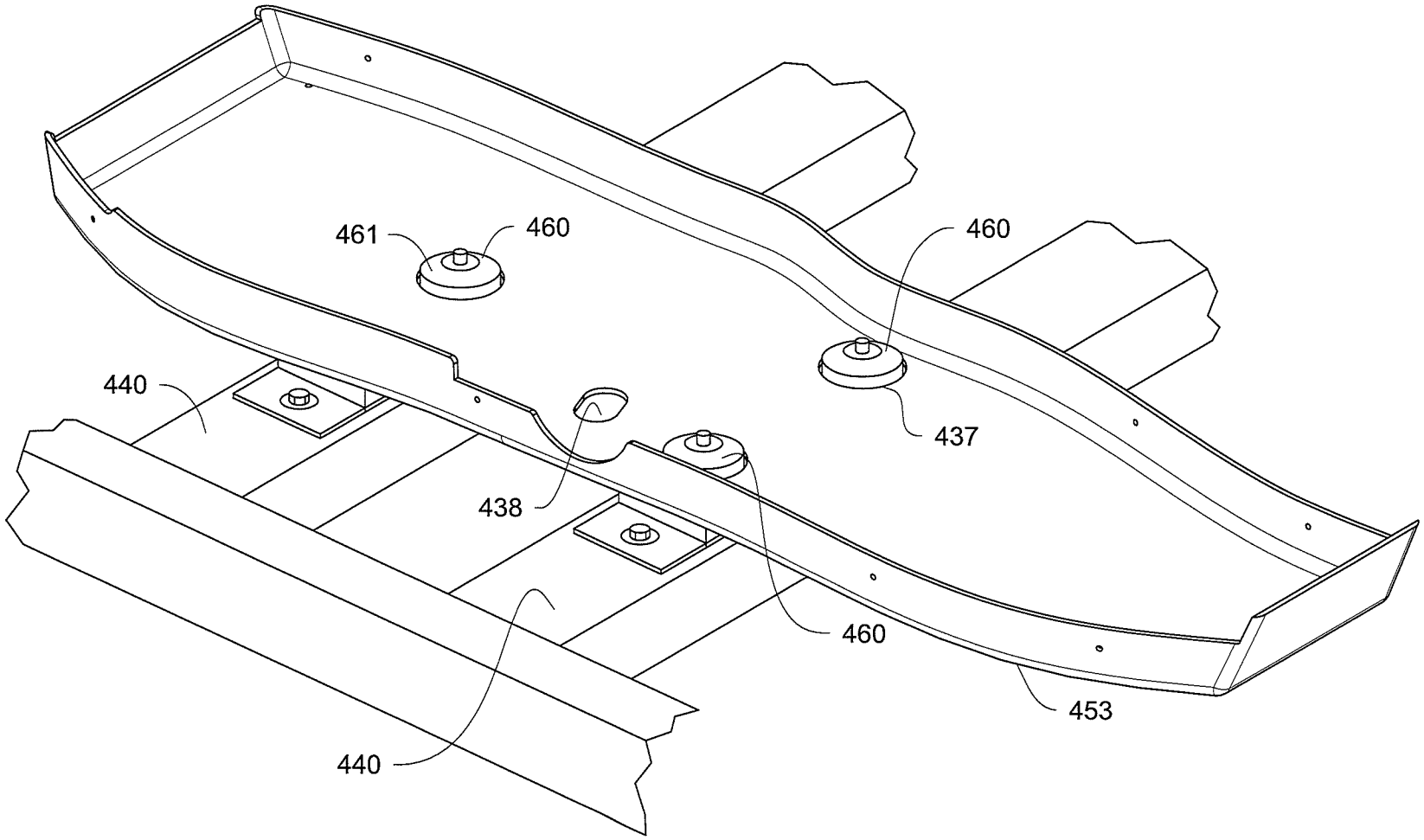
FIG. 4 illustrates a bottom section of a sound enclosure that is installed in a chiller system.

FIG. 4 illustrates a bottom section 453 that is assembled to supporting beams 440 of a chiller system. The supporting beams 440 are generally positioned underneath the bottom section 453. The bottom section 453 may have a plurality of apertures 437 that are configured to accommodate mounting mechanisms 460 to support a compressor (not shown).

Each of the mounting mechanisms 460 includes a sound isolator 461 that is positioned between the compressor and the supporting beams 440. The sound isolators 461 support the compressor and are configured to impede vibration transmission between the compressor and the supporting beam 440. The sound isolators 461 may be made of sound damping materials, such as rubber. The sound isolators 461 as illustrated in FIG. 4 may be generally used to attenuate the operation noise of a compressor of a chiller system, such as a screw compressor. It is to be noted, the sound isolators may also be used to install other suitable compressors to supporting beams. The compressors in the embodiments as illustrated in the Figures of this document can also use similar sound isolator to support the compressors.

When assembled, a portion of the bottom section 453 is positioned between the supporting beams 440 and the compressor. However, the bottom section 453 is configured so that the bottom section 453 does not contact the compressor directly.

The bottom section 453 is also configured to have an access opening 438. The access opening 438 may accommodate, for example, an oil line to the compressor. When in use, the sound enclosure as described herein may be used outdoors and may be subject to environmental elements, such as rain and snow. Consequently, water may get into the sound enclosure. Sometimes, condensation water may accumulate inside the sound enclosure. The bottom section 453 can also be configured to have an opening(s) similarly arranged and constructed as the openings 438, but used for drainage purposes. The bottom section 453 may also include openings different from the openings 438.

Figure 5:
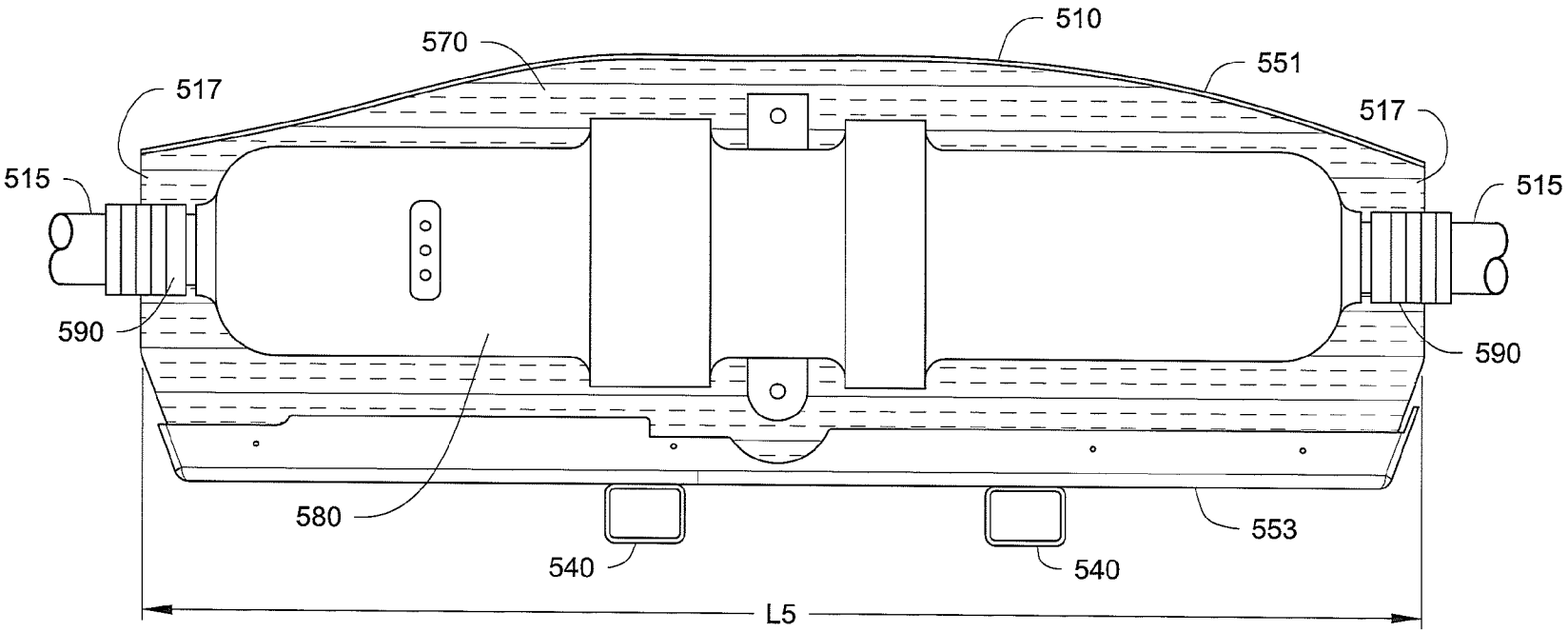
FIG. 5 illustrates cut-away side view of an assembled sound enclosure enclosing a compressor.

FIG. 5 illustrates a compressor 580 that is positioned in a sound enclosure 510. One side section of the sound assembly 510 is cut away for clearer illustration. The compressor 580 is generally enclosed by the sound enclosure 510. The compressor 580 is positioned so that the compressor 580 does not touch the sound enclosure 510 directly. The sound enclosure 510 generally extends in a longitudinal direction that is defined by a length L5. The longitudinal direction is generally about parallel to a refrigerant flow direction through the compressor 580. The sound enclosure 510, particularly a side section 551 (and the cut-away side section), has a surface contour that generally extends in the longitudinal direction and conforms to a profile of the compressor 580. In some embodiments, the surface contour can be configured so that the side section 551 maintains a relatively constant distance from an outline of the profile of the compressor 580.

In addition, an area between the compressor 580 and the sound enclosure 510 may contain sound damping materials, for example, foam 570. For example, in some embodiments, a layer(s) of the foam can be attached to an inner surface of the sound enclosure. In some embodiments, the area between the compressor 580 and the sound enclosure 510 may be filled or partially filled with the sound damping materials. In one embodiment, the sound damping material is attached to the sound enclosure 510 and has a space between the sound damping material and the compressor 580.

The sound damping materials can be fiber glass, rock wool, vinyl barriers, foam or other acoustics materials.

Two ends of the compressor 580 are equipped with in-line sound isolating devices 590 along the refrigerant lines 515, such as for example, devices with flexible bellow structures. The sound isolating devices 590 can impede transmission of the sound generated by the compressor 580 to the refrigerant lines 515 in the longitudinal direction that is defined by the length L5.

End openings 517 of the sound enclosure 510 are configured to accommodate the sound isolating devices 590 and/or refrigerant lines 515. Because the in-line sound isolating device 590 can impede transmission of the sound in the longitudinal direction, the end openings 517 may not necessarily to be configured to impede and/or attenuate sound. In one embodiment, the in-line sound isolating device 590 can include a heavy flange(s) that helps impede sound from transmitting out of the sound enclosure.

In operation, the compressor 580 can emit sound radiantly to the environment. The sound enclosure 517 and/or the foam 570 can impede and/or absorb sound emitted by the compressor 580 so as to attenuate an operational sound level of the compressor 580. In some embodiments, the compressor 580 can be a screw compressor.

The compressor 580 can be supported by, for example, sound isolators 461 that are illustrated in FIG. 4 at a bottom of the compressor 580. Consequently, the bottom of the compressor 580 generally does not touch a bottom section 553 of the sound enclosure 510.

The sound generated by the compressor 580 is isolated and/or absorbed by a plurality of mechanisms. In the longitudinal direction, the in-line sound isolating devices 590 are configured to impede sound transmission between the compressor 580 and the refrigerant lines 515. This in-line sound isolating device 590 can particularly help impede the structure borne sound. The compressor 580 is also isolated from the supporting beams 540 by sound isolators, such as the sound isolators 461 as illustrated in FIG. 4. The sound isolators 461 can impede sound transmission from the compressor to the supporting beams 540. Further, the sound enclosure 510 and/or foam 570 can impede and/or absorb sound emitted radiantly, such as air borne sound by the compressor 580 and/or the sound isolating devices 590. The sound enclosure 510 and/or foam 570 can particularly help impede air borne sound. In some embodiments, the sound enclosure 510 may be configured to attenuate sound particularly from a range of about 250 Hz to about 1000 Hz. In some embodiments, the sound enclosure 510 may be configured to attenuate sound particularly from a range of about 250 Hz to about 10,000 Hz. In some embodiments, the sound enclosure 510 may be configured to attenuate sound particularly from a range of 2,000 Hz to about 10,000 Hz.

In some embodiments, the sound enclosure may be equipped with one or more end plugs (e.g. end plugs 660 in FIGS. 6A and 6B below) that are configured to plug the end openings 617 to provide another sound impeding layer for the air borne sound emitted by, for example, the compressor 580 and/or the sound isolating devices 590.

Figure 6A:
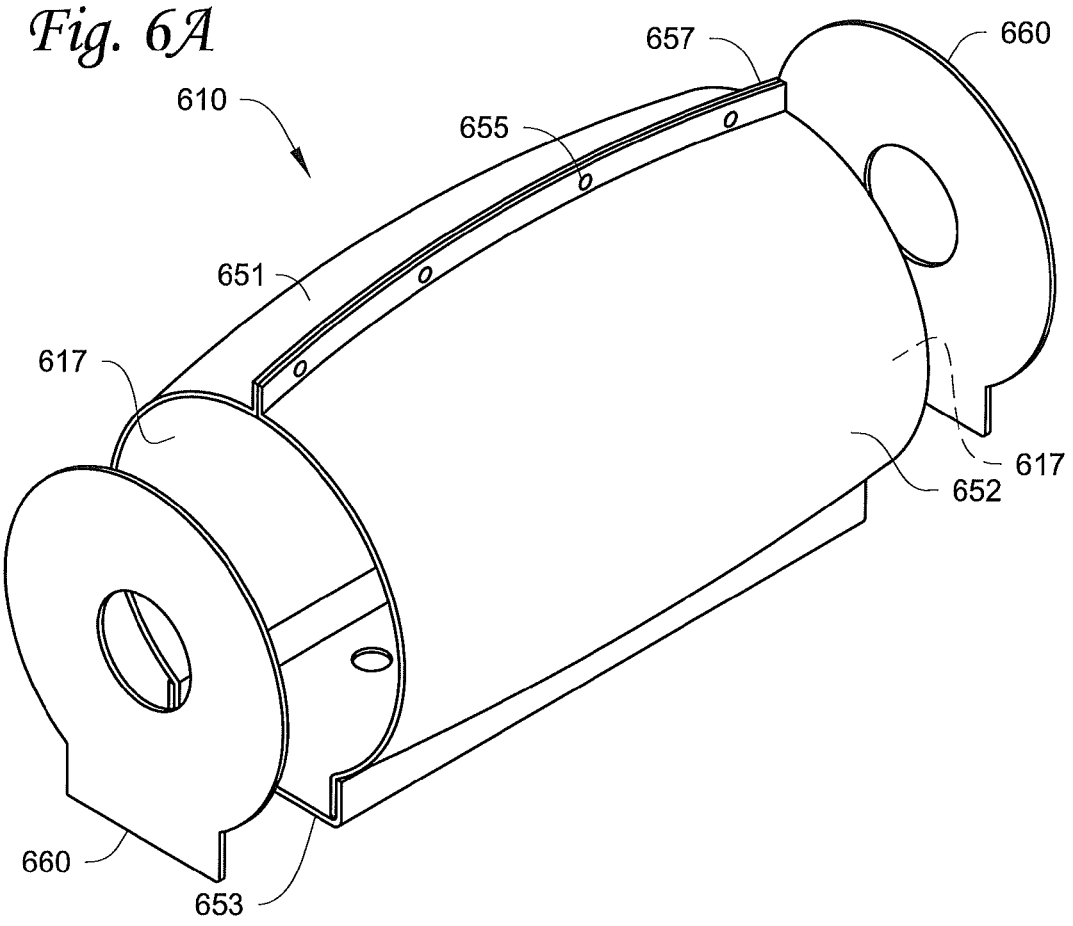
FIGS. 6A and 6C illustrate yet another embodiment of a sound enclosure.
Figure 6B:
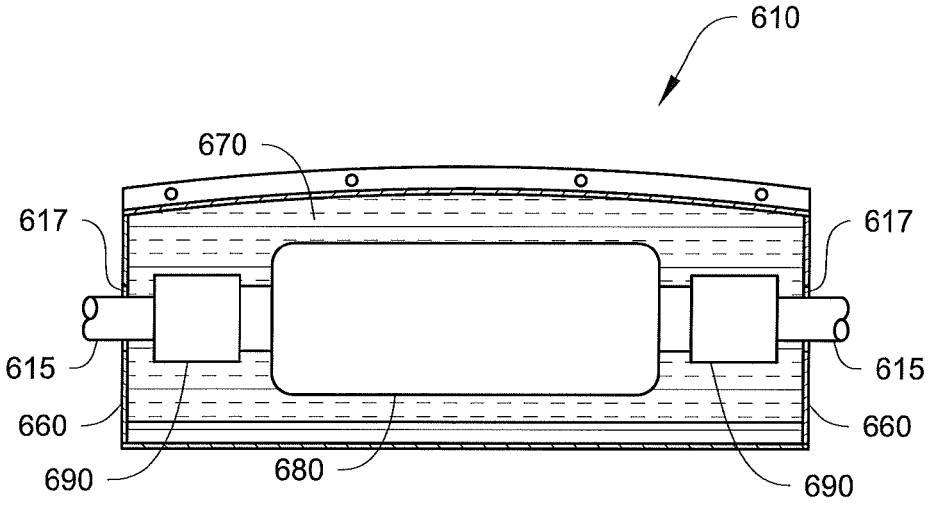
FIG. 6B is a cut-away side view of the sound enclosure.
Figure 6C:
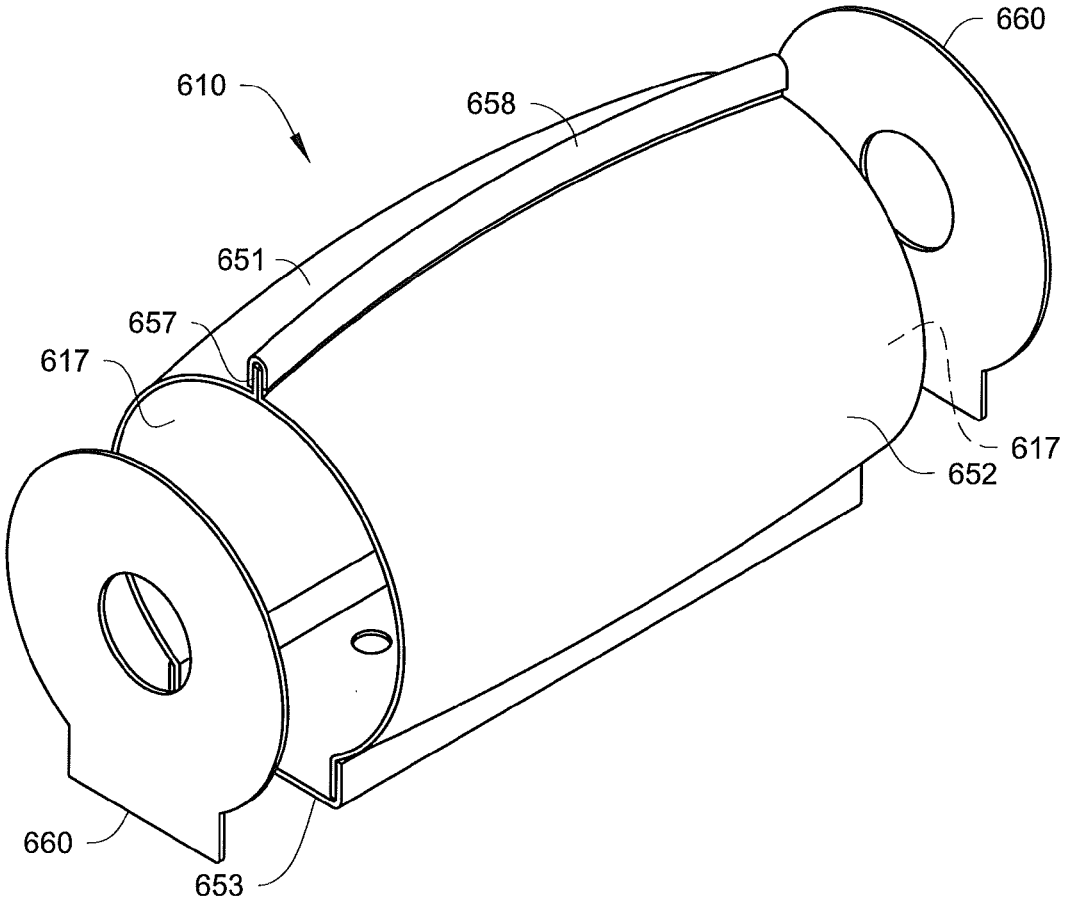

FIGS. 6A, 6B and 6C illustrate another embodiment of a sound enclosure 610. The sound enclosure is configured to have side sections 651 and 652, and a bottom section 653. The side sections 651 and 652 may be configured to have raised edges 657. The raised edges 657 of the side sections 651 and 652 can overlap with each other to form a seam so that the side sections 651 and 652 may be joined together by, for example, bolts 655 at the overlapped raised edges 657.

As illustrated in FIG. 6C, the side sections 651 and 652 can also be joined together by a trim strip 658 over the raised edges 657. The side sections 651 and 652 can also be joined together by other suitable methods, such as one or more clamps clipped on the raised edges 657.

The sound enclosure 610 may also be equipped with end plugs 660. The end plugs 660 can be used to plug or cover the end openings of the sound enclosure 610. The end plugs 660 may be made of sound impeding materials, such as foam, to provide a further sound impeding layer to impede sound, particularly air borne sound.

A side schematic view of the sound enclosure 610 is illustrated in FIG. 6B. The sound enclosure 610 is configured to generally enclose a compressor 680 and in-line sound isolating devices 690. An area between the sound enclosure 610 and the compressor 680 and/or the sound isolating devices 690 may contain a sound damping material 670, such as foam. Longitudinal ends of the sound enclosure 610 have the openings 617 to allow refrigerant lines 615 to exit the sound enclosure 610. The openings 617 may not need to be configured to impede sound. As illustrated, the end plugs 660 are used from inside of the sound enclosure 610 to plug or cover the openings 617. It is noted that the sound plugs 660 may be also configured to cover the openings 617 from outside of the sound enclosure 610. The end plugs 660 also have openings to accommodate, for example, refrigerant lines.

The assembly sections of the sound enclosure may be molded. In some embodiments, the sound enclosure may include three sections: two side sections and one bottom sections as illustrated above. In some embodiments, the sound enclosure may include more or less than three sections, such as two side sections. Generally, the sound enclosure may include two side sections extending in a longitudinal direction that is generally parallel to a refrigerant flow direction through a compressor. The sound enclosure may also have a surface contour that conforms to a profile of the compressor. The two side sections may be assembled similar to two halves of a clam shell so as to accommodate a compressor. Because the sound enclosure can be assembled from just a few pieces, such as two or three, of side and/or bottom sections, the sound enclosure can be assembled relatively easily.

The sound enclosure as described, for example in FIG. 5, is configured to generally accommodate a HVAC compressor with a horizontally or near horizontally positioned crankshaft, such as a screw compressor. Generally, the sound enclosure as described, for example in FIG. 5 is configured to accommodate a HVAC compressor with a relatively long length compared to a height of the compressor. It is to be noted that embodiments of the sound enclosure as described herein can also be configured to accommodate a HVAC compressor with a vertical or near vertically positioned crankshaft, such as a scroll compressor. Generally, the sound enclosure as described herein can also be configured to accommodate a HVAC compressor with a relatively larger height compared to a width of the compressor.

Figure 7A:
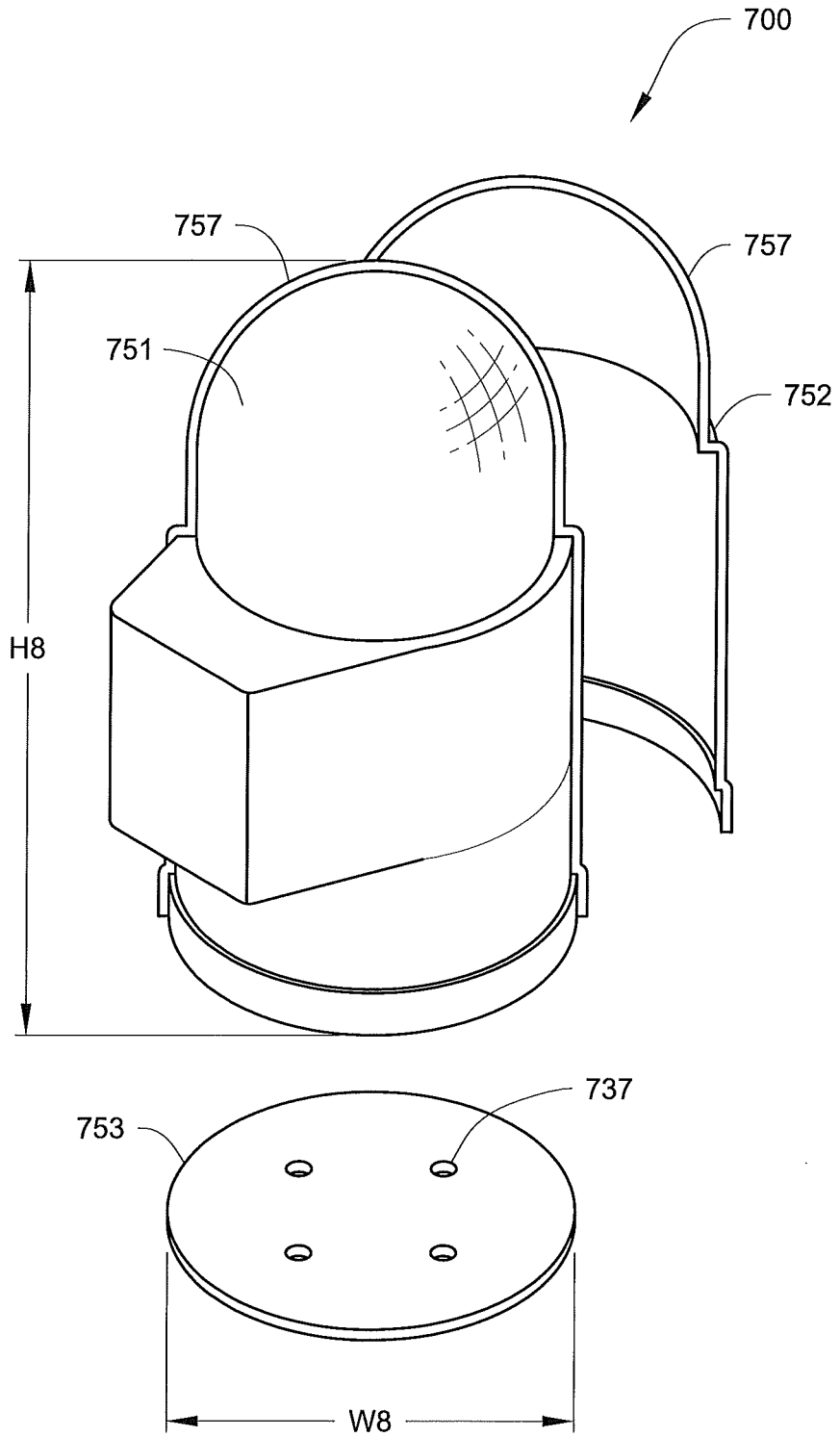
FIGS. 7A to 7C illustrate another embodiment of a sound enclosure.
Figure 7B:
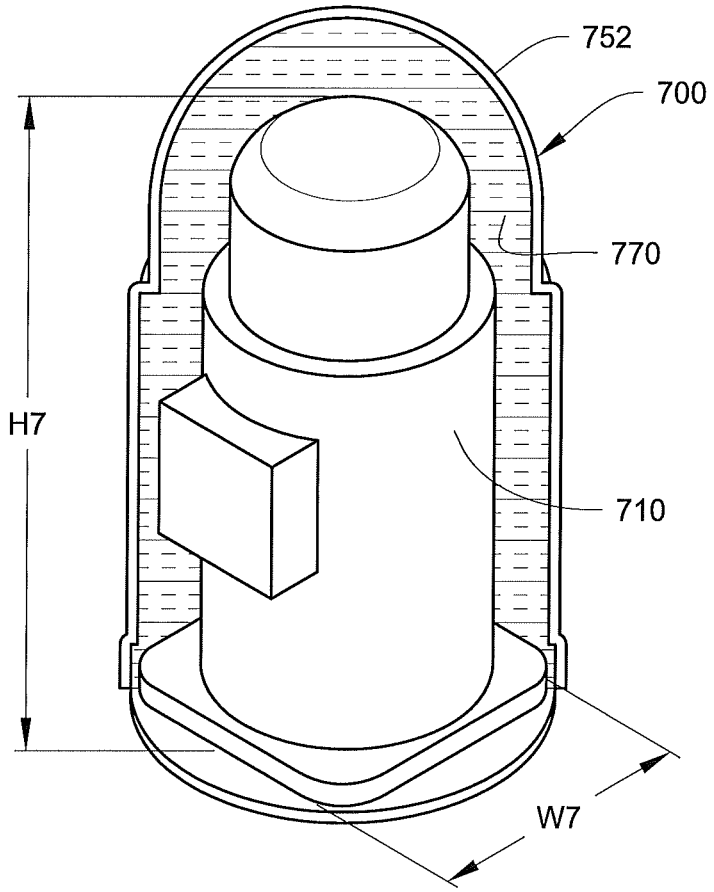
Figure 7C:
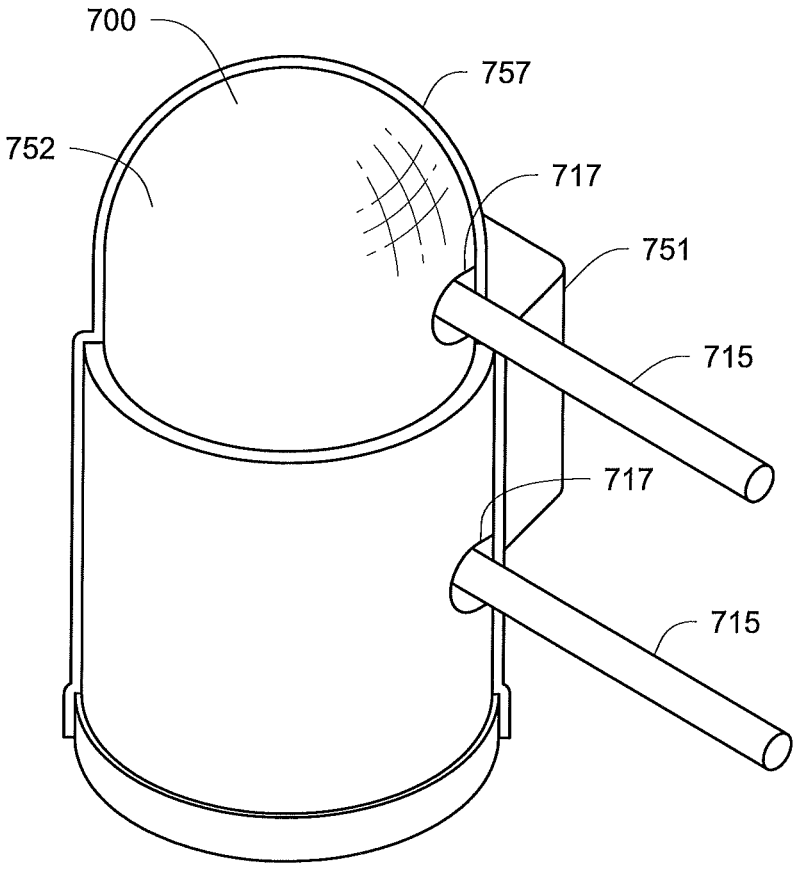

FIGS. 7A to 7C illustrate a sound enclosure 700 that can accommodate a compressor 710 (as illustrated in FIG. 7B) that has a relatively larger height H7 in the vertical condition than a width W7 of the compressor 710.

As illustrated in FIG. 7A, the sound enclosure 700 includes two side sections 751 and 752, and a bottom section 753. The side sections 751, 752 and the bottom section 753 can be assembled to form an enclosed space to accommodate the compressor 710.

Referring to FIGS. 7A and 7B, surface contours of the side section 751 and/or the side section 752 can be configured to generally follow surface contours of the compressor 710. As illustrated in FIG. 7B, the contours of the side section 752 (as well as the side section 751 as shown in FIG. 7A) generally has a relatively uniform distance from a surface of the compressor 710. A space between the sound enclosure 700 and the surface of the compressor 710 can be layered with a sound damping material 770, such as for example foam.

The sound enclosure 700 has a height H8 and a width W8. As illustrated in FIG. 7A, the height H8 is relatively larger than the width W8 to accommodate the compressor 710, which also has the relatively larger height H7 compared to the width W7.

The side sections 751 and 752 have raised edges 757. The raised edge 757 of the side section 751 can overlap with the raised edge 757 of the side section 752 to form a seam. The raised edge 757 can be used to help retain the side sections 751 and 752 together by, for example, bolts through the raised edges 757 or a trim strip over the raised edges 757.

The bottom section 753 includes one or more apertures 737 that can be configured to, for example, accommodate a mounting mechanism from the compressor 700.

Referring to FIG. 7C, the sound enclosure 700 may include one or more openings 717 configured to allow access of refrigerant lines 715 to the compressor 710 (not shown in FIG. 7C, see FIG. 7B) enclosed by the sound enclosure. As illustrated, the opening 717 can open through the seam formed by the overlapped raised edges 757. The opening 717 can be on a side of the side sections 751 and/or 752 along the height H7.

The sound enclosures as described herein may be generally configured to impede and/or absorb sound radiantly emitted by the compressor, while allowing refrigerant lines to access the compressor from openings at longitudinal ends of the sound enclosure. The sound enclosure may also be configured to have openings and apertures to accommodate junction box, wire bundle, oil lines, etc. that are coupled to the compressor. A bottom of the sound enclosure may be configured to have openings to accommodate sound isolators supporting the compressor and isolating the compressor from supporting beams of a chiller system. The assembly sections may be separated from the compressor by one or more sound damping layers, such as foam layer(s).

Generally, the sound enclosure may be made of a sound barrier material that can help block the acoustic energy. The space between the sound enclosure and the compressor may be layered with one or more layers of sound absorbing material and/or sound blocking material to help damp the acoustic energy.

In some embodiments, the side and/or bottom sections of the sound enclosure may be made of a plastic or composite material, such as for example ABS or other suitable hard materials, which can help block the acoustic energy. In some embodiments, the sound damping materials positioned next to the side sections and/or the bottom sections can be a sound absorption material, such as a foam or a mass loaded vinyl, that helps absorb acoustic energy and/or a sound barrier material that helps block acoustic energy.

In some embodiments, the side and/or bottom sections of the sound enclosure may be made of a material that may be more flexible and/or more dense than ABS, such as thermoplastic elastomer (TPE) and/or thermoplastic olefin (TPL), so that the side and/or bottom sections can help both absorb and block acoustic energy.

In some embodiments, the sound damping layer next to the side sections and/or bottom sections can be a composite of two absorption material layers with a sound barrier in between. When the side and/or bottom sections are made of a material that can help both absorb and block acoustic energy, the sound damping layer next to the side and/or bottom sections can be one or more absorption material layer.

During a manufacturing process, the sound damping material may be held by a supporting structure to help attach the sound damping material to the sound barrier, such as a plastic bag or a screen. In some embodiments, the sound absorbing material and/or sound barrier material can be put in a relatively thin plastic bag, and then the bag may be attached to the side and/or bottom sections. In some embodiments, the sound absorption material and/or sound barrier material can be attached to and held by a screen attached to the side and/or bottom sections. In some embodiments, riveted clips with a washer and/or a lock washer can be used to attach the plastic bag and/or the screen to the side and/or bottom sections.

The sound enclosure can also be configured to have a water drainage opening(s) to facilitate removal of water accumulation inside the sound enclosure.

ASPECTS

Any aspects 1-9 can be combined with any aspects 10-18.

Aspect 1. A sound enclosure for a compressor of a HVAC system comprising:

a first side section and a second side section; and a bottom section;

wherein the sound enclosure is configured to enclose the compressor of the HVAC system to impede operational sound emitted radiantly by the compressor, the bottom section includes a plurality of apertures to accommodate a mounting mechanism for the compressor of the HVAC system, the first side section and the second side section, the first side section and the bottom section, and the second side section and the bottom section have overlap sections, and the first section and the second side section, the first side section and the bottom section, and the second side section and the bottom section are joined together at the overlap sections, and the first side section and the second side section configured to create a space between the first and second side sections and the compressor when the compressor is inside the sound enclosure.

Aspect 2. The sound enclosure of aspect 1, wherein the first side section or the second side section is configured to have at least one opening to accommodate a junction box for the compressor of the HVAC system.

Aspect 3. The sound enclosure of aspects 1-2, wherein the contours of the first side section and the second side section are configured so that the first section and the second side section maintain a relatively constant distance toward an outline of the compressor when installed.

Aspect 4. The sound enclosure of aspects 1-3, wherein the first side section, the second side section or the bottom section include at least one opening to accommodate a wire or a refrigerant line that is configured to be connected to the compressor of the HVAC system.

Aspect 5. The sound enclosure of aspects 1-4, wherein the sound enclosure has a curved profile from a side view.

Aspect 6. The sound enclosure of aspects 1-5, wherein the bottom section of the sound enclosure is configured to have a drainage opening.

Aspect 7. The sound enclosure of aspects 1-6, wherein an opening is opened through a seam formed by the overlap sections of the first and second side sections.

Aspect 8. The sound enclosure of aspects 1-7, wherein the sound enclosure has a length and a height, the length is larger than the height, and the sound enclosure is configured to accommodate a compressor has a horizontally positioned crankshaft.

Aspect 9. The sound enclosure of aspects 1-8, wherein the sound enclosure has a length and a height, the height is larger than the length, and the sound enclosure is configured to accommodate a compressor has a vertically positioned crankshaft.

Aspect 10. A chiller system comprising:

a compressor;

a sound enclosure configured to enclose the compressor, the sound enclosure having openings; and refrigerant lines coupled to the compressor through the openings;

wherein the compressor is supported by a mounting mechanism through an aperture of a bottom section of the sound enclosure.

Aspect 11. The chiller system of aspect 10, wherein the sound enclosure includes a side section that is configured to have an opening to accommodate a junction box for the compressor.

Aspect 12. The chiller system of aspects 10-11, wherein the sound enclosure is configured to impede operational sound radiantly emitted by the compressor.

Aspect 13. The chiller system of aspects 10-12, wherein the mounting mechanism supporting the compressor is configured to impede sound transmission between the compressor and a supporting beam of the chiller system.

Aspect 14. The chiller system of aspects 10-13, wherein the refrigerant lines of the compressor are equipped with in-line sound isolating devices that are configured to impede sound transmission between the compressor and the refrigerant lines.

Aspect 15. The chiller system of aspects 10-14, wherein the sound enclosure has a contour extending in a longitudinal direction, the contour is configured so that the sound enclosure maintains a relatively constant distance toward an outline of the compressor.

Aspect 16. The chiller system of aspects 10-15, wherein a bottom of the sound enclosure is configured to have a drainage opening.

Aspect 17. The chiller system of aspects 10-16, wherein the compressor has a horizontally positioned crankshaft and the sound enclosure has a length that is larger than a height.

Aspect 18. The chiller system of aspects 10-17, wherein the compressor has a vertically positioned crankshaft and the sound enclosure has a height that is larger than the length.

With regard to the foregoing description, it is to be understood that changes may be made in detail, especially in matters of the construction materials employed and the shape, size and arrangement of the parts without departing from the scope of the present invention. It is intended that the specification and depicted embodiment to be considered exemplary only, with a true scope and spirit of the invention being indicated by the broad meaning of the claims.

What claimed is:

1. A sound enclosure for a screw compressor in a heating, ventilation, and air conditioning (HVAC) system, comprising:

a first side section and a second side section that close in a clam shell configuration, a connection between the first and second side sections extending in a longitudinal direction along a top side of the sound enclosure from a first longitudinal end to a second longitudinal end opposite the first longitudinal end, the first side section and the second side section configured to create a space between the first and second side sections and the screw compressor when the screw compressor is inside the sound enclosure;

a bottom section extending in the longitudinal direction of the sound enclosure and configured to create a space between the bottom section and the screw compressor when the screw compressor is inside the sound enclosure, the bottom section including a plurality of apertures to accommodate a mounting mechanism for the screw compressor and to accommodate the mounting mechanism to extend therethrough, wherein the bottom section is configured so that the bottom section does not contact the screw compressor directly; and one or more end plugs that plug or cover the first and second longitudinal ends of the sound enclosure, wherein the sound enclosure is configured to radially surround the screw compressor to impede operational sound emitted radiantly by the screw compressor, wherein the sound enclosure has a length and a height, the length being larger than the height, and the sound enclosure configured to accommodate the screw compressor having a horizontally positioned crankshaft, wherein a variable surface contour of the first side section and a variable surface contour of the second side section are designed to follow a variable profile of the screw compressor, the variable surface contours being configured so that the first side section and the second side section maintain a relatively constant distance from an outline of the variable profile of the screw compressor when installed, and the bottom section includes a portion extending toward a top side of the screw compressor such that, in a fastened configuration, the first and second side sections are fastened to the bottom section and radially surround the screw compressor, wherein the portion of the bottom section is disposed on an outer side of the first and second side sections.

2. The sound enclosure of claim 1, wherein the first side section, the second side section or the bottom section include at least one opening to accommodate a wire or a refrigerant line that is configured to be connected to the screw compressor.

3. The sound enclosure of claim 1, wherein the sound enclosure has a curved profile from a side view.

4. The sound enclosure of claim 1, wherein the bottom section is configured to have a drainage opening.

5. The sound enclosure of claim 1, wherein an opening is opened through a seam formed by overlap sections of the first and second side sections.

6. The sound enclosure of claim 1, wherein the one or more end plugs are configured to reduce sound emitted from the first and second longitudinal ends of the sound enclosure.

7. The sound enclosure of claim 6, wherein the one or more end plugs are made of a sound impeding material.

8. The sound enclosure of claim 6, wherein the one or more end plugs include an opening configured to accommodate a refrigerant line.

9. The sound enclosure of claim 1, wherein the portion of the bottom section surrounds a perimeter of the sound enclosure.

10. A chiller system, comprising:

a screw compressor having a horizontally positioned crankshaft;

a sound enclosure configured to radially surround the screw compressor, the sound enclosure having longitudinal end openings and having a length and a height, the length being larger than the height;

one or more end plugs that plug or cover the longitudinal end openings; and refrigerant lines coupled to the screw compressor through the longitudinal end openings;

wherein the screw compressor is supported by a mounting mechanism extending through an aperture of a bottom section of the sound enclosure so that the bottom section does not contact the screw compressor directly and a space is maintained between the screw compressor and the bottom section, the bottom section extending in the longitudinal direction of the sound enclosure, and wherein the sound enclosure includes side sections having a variable surface contour designed to follow a variable profile of the screw compressor, the variable surface contour being configured so that the side sections maintain a relatively constant distance from an outline of the variable profile of the screw compressor when installed, and the side sections close in a clam shell configuration, a connection between the first and second side sections extending in a longitudinal direction along a top side of the sound enclosure from a first of the longitudinal end openings to a second of the longitudinal end openings opposite the first, and the bottom section includes a portion extending toward a top side of the screw compressor such that, in a fastened configuration, the side sections are fastened to the bottom section and radially surround the screw compressor, wherein the portion of the bottom section is disposed on an outer side of the side sections.

11. The chiller system of claim 10, wherein the sound enclosure is configured to impede operational sound radiantly emitted by the screw compressor.

12. The chiller system of claim 10, wherein the mounting mechanism supporting the screw compressor is configured to impede sound transmission between the screw compressor and a supporting beam of the chiller system.

13. The chiller system of claim 10, wherein the bottom section is configured to have a drainage opening.

14. The chiller system of claim 10, wherein the one or more end plugs are configured to reduce sound emitted from the longitudinal end openings of the sound enclosure.

15. The chiller system of claim 14, wherein the one or more end plugs are made of a sound impeding material.

16. The chiller system of claim 14, wherein the one or more end plugs include an opening configured to accommodate a refrigerant line.

17. The chiller system of claim 10, further comprising:

a supporting beam, wherein the mounting mechanism is fixed to the supporting beam and the mounting mechanism includes a sound isolator positioned between the screw compressor and the supporting beam.

18. The chiller system of claim 10, wherein the portion of the bottom section surrounds a perimeter of the sound enclosure.

* * * * *